US011746401B2

(12) United States Patent
Koh et al.

(10) Patent No.: US 11,746,401 B2
(45) Date of Patent: Sep. 5, 2023

(54) STEEL SHEET HAVING EXCELLENT HYDROGEN INDUCED CRACKING RESISTANCE AND LONGITUDINAL STRENGTH UNIFORMITY, AND MANUFACTURING METHOD THEREFOR

(71) Applicant: POSCO, Pohang-si (KR)

(72) Inventors: Seong-Ung Koh, Pohang-si (KR); Hyo-Shin Kim, Pohang-si (KR); Yoen-Jung Park, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 16/955,856

(22) PCT Filed: Dec. 3, 2018

(86) PCT No.: PCT/KR2018/015165

§ 371 (c)(1),
(2) Date: Jun. 19, 2020

(87) PCT Pub. No.: WO2019/124814

PCT Pub. Date: Jun. 27, 2019

(65) Prior Publication Data

US 2020/0332401 A1 Oct. 22, 2020

(30) Foreign Application Priority Data

Dec. 22, 2017 (KR) ..... 10-2017-0178859

(51) Int. Cl.
*C22C 38/50* (2006.01)
*C22C 38/00* (2006.01)
(Continued)

(52) U.S. Cl.
CPC ..... *C22C 38/50* (2013.01); *C21D 8/0226* (2013.01); *C22C 38/001* (2013.01);
(Continued)

(58) Field of Classification Search
CPC ..... C22C 38/50; C22C 38/001; C22C 38/002; C22C 38/02; C22C 38/04; C21D 2211/005
(Continued)

(56) References Cited

U.S. PATENT DOCUMENTS

2009/0301613 A1 12/2009 Koo et al.
2014/0144552 A1 5/2014 Kami et al.
(Continued)

FOREIGN PATENT DOCUMENTS

EP 2290112 A1 3/2011
EP 2623625 A2 * 8/2013 ..... C22C 38/50
(Continued)

OTHER PUBLICATIONS

Noritaka et al., JP 4523010 B2 machine translation, Feb. 19, 2007, entire translation (Year: 2007).*
(Continued)

*Primary Examiner* — Humera N. Sheikh
*Assistant Examiner* — Katherine A Christy
(74) *Attorney, Agent, or Firm* — Morgan, Lewis & Bockius LLP

(57) ABSTRACT

Steel sheets and methods for manufacturing same useful for a line pipe or the like can have excellent hydrogen induced cracking resistance, and longitudinal strength uniformity. The Sttel sheets can include certain amounts of carbon (C), silicon (Si), manganese (Mn), phosphorus (P), sulfur (S), aluminum (Al), nitrogen (N), niobium (Nb), titanium (Ti), calcium (Ca), one or more selected from a group consisting of nickel (Ni), chromium (Cr), molybdenum (Mo), vanadium (V), and a balance of iron (Fe) and other inevitable impurities. A microstructure of the steel sheet can be comprised of ferrite or a composite structure of ferrite and acicular ferrite, and upper bainite is included in an area of 5% or less in a center portion of the thickness of the steel sheet.

11 Claims, 2 Drawing Sheets

(51) Int. Cl.

| | |
|---|---|
| ***C22C 38/02*** | (2006.01) |
| ***C22C 38/04*** | (2006.01) |
| ***C21D 8/02*** | (2006.01) |
| ***C22C 38/06*** | (2006.01) |
| ***C22C 38/44*** | (2006.01) |
| ***C22C 38/46*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C21D 2211/002* (2013.01); *C21D 2211/005* (2013.01)

(58) Field of Classification Search
USPC ..... 428/544
See application file for complete search history.

(56) References Cited

U.S. PATENT DOCUMENTS

| | | | | |
|---|---|---|---|---|
| 2015/0368737 | A1 | 12/2015 | Goto et al. | |
| 2018/0105907 | A1 | 4/2018 | Ota et al. | |
| 2020/0181728 | A1* | 6/2020 | Hashimoto | C21D 6/004 |

FOREIGN PATENT DOCUMENTS

| | | | | |
|---|---|---|---|---|
| JP | H05-195057 | A | | 8/1993 |
| JP | 2002-363689 | A | | 12/2002 |
| JP | 2004-003015 | A | | 1/2004 |
| JP | 4523010 | B2 | * | 8/2010 |
| JP | 2016-108648 | A | | 6/2016 |
| JP | WO 2014/115548 | A1 | | 1/2017 |
| KR | 10-0815717 | B1 | | 3/2008 |
| KR | 10-2009-0078807 | A | | 7/2009 |
| KR | 10-2011-0062902 | A | | 6/2011 |
| KR | 10-2011-0102483 | A | | 9/2011 |
| KR | 10-1359082 | B1 | | 2/2014 |
| KR | 10-2017-0075936 | A | | 7/2017 |
| KR | 10-2017-0128570 | A | | 11/2017 |
| KR | 10-2017-0133310 | A | | 12/2017 |
| WO | 2010/095730 | A1 | | 8/2010 |

OTHER PUBLICATIONS

European Search Report dated Aug. 14, 2020 issued in European Patent Application No. 18891811.4.

International Search Report dated Mar. 7, 2019 issued in International Patent Application No. PCT/KR2018/015165 (along with English translation).

* cited by examiner

【FIG. 1】
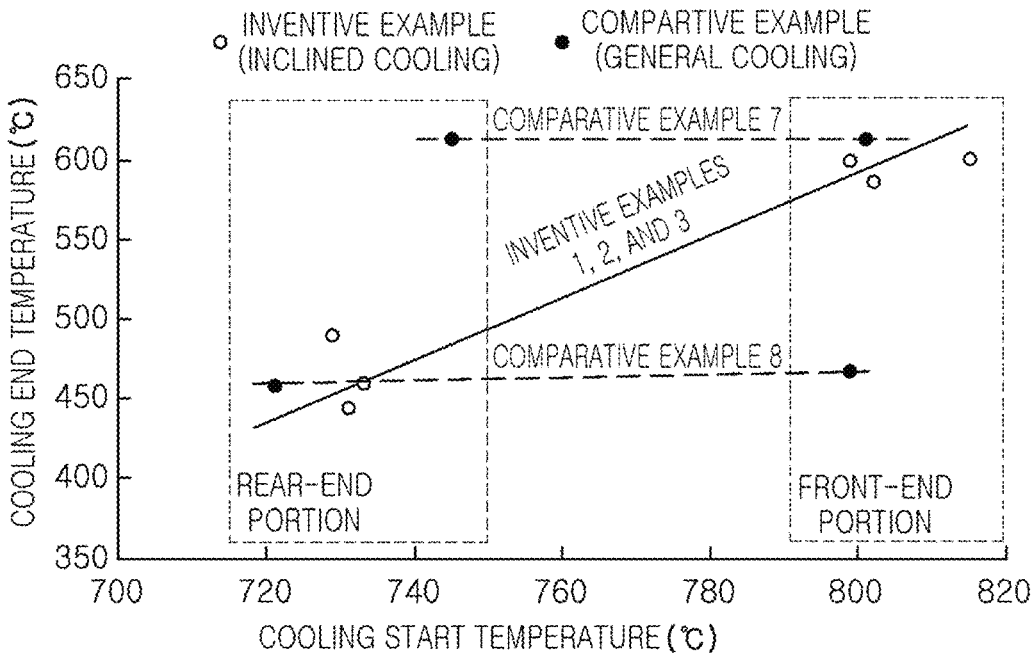

【FIG. 2】
(a) PRIOR ART
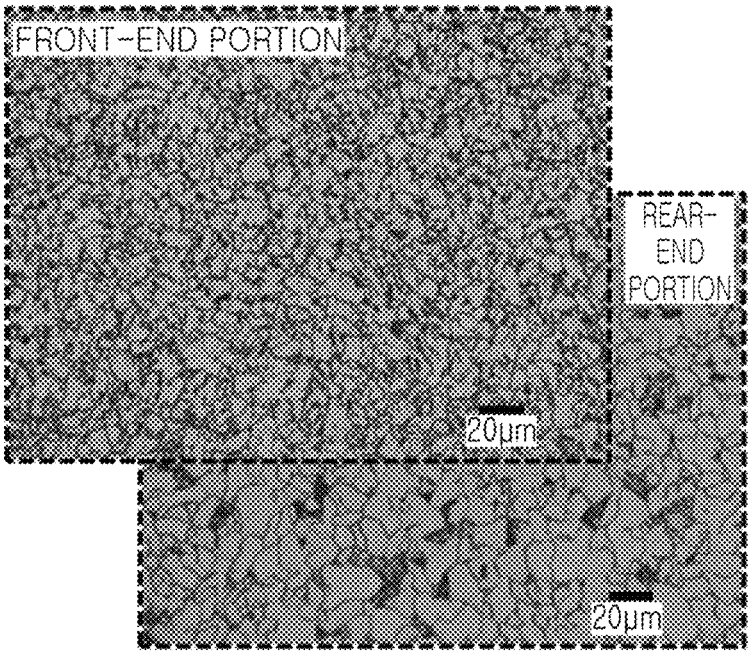
(b)
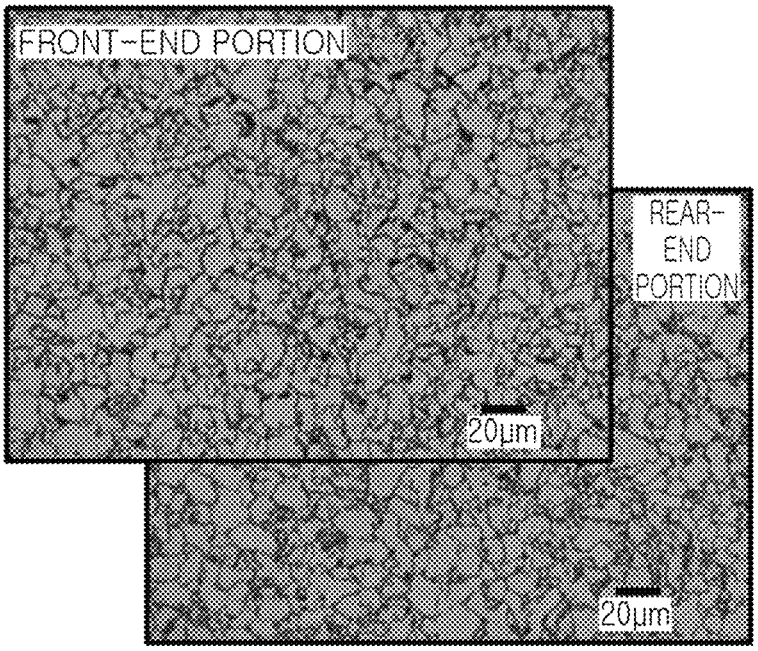

STEEL SHEET HAVING EXCELLENT HYDROGEN INDUCED CRACKING RESISTANCE AND LONGITUDINAL STRENGTH UNIFORMITY, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2018/015165, filed on Dec. 3, 2018, which in turn claims the benefit of Korean Application No. 10-2017-0178859, filed on Dec. 22, 2017, the entire disclosures of which applications are incorporated by reference herein.

TECHNICAL FIELD

The present invention relates to steel sheet used for a pipeline, and the like, and relates to a steel sheet having excellent hydrogen induced cracking resistance and strength uniformity in a longitudinal direction, and a method for manufacturing the same.

BACKGROUND ART

Efforts to reduce costs of raw materials used for mining are continuing to secure profitability in crude oil and natural gas. As a part of these efforts, efforts have been made to replace conventional low-strength thick steel pipes with high-strength thin material steel pipes. The use of high-strength thin material steel pipes may reduce an amount of raw materials used at the same transport pressure, thereby reducing the costs.

Due to the characteristics of the thick steel plate production line, cooling after rolling starts from a front-end portion of a plate in a longitudinal direction, and a rear end portion is finally cooled, so variations in cooling occurs from the front-end portion to the rear-end portion, and the variations in cooling becomes much larger as the thickness of the product decreases, and has a problem in that strength decreases due to generation of air-cooled ferrite before water cooling toward the rear-end portion of the plate. The thick steel sheet usually used for pipelines is provided with a length of about 12 m on a product basis, and since 2 or 3 products are cut and produced from 1 plate, it has a minimum length of about 24 m or more, based on the plate. However, as described above, due to the characteristics of the production process of the thick steel plate, an increase in air-cooled ferrite before water cooling increases from the front-end portion of the plate to the rear-end portion thereof increases the variations in strength of the front-end portion and the rear-end portion, resulting in product defects.

Through low-temperature rolling and air cooling, the variations in strength in the longitudinal direction can be reduced, but since low-temperature rolling is required to secure the strength within a range of component specifications of pipeline steel, the hydrogen induced cracking resistance of the steel material is deteriorated, and an increase in strength by grain refinement may also cause a poor yield ratio. In particular, as the thickness of the thick steel sheet decreases, a total rolling reduction rate of a steel slab increases, so the inclusions are crushed during rolling, and hydrogen induced cracking is generated due to these defects, such that hydrogen induced cracking (HIC) resistance of the thin material thick plate material decreases.

DISCLOSURE

Technical Problem

An aspect of the present disclosure is to provide a steel sheet having excellent strength, excellent hydrogen induced cracking resistance, and excellent strength uniformity due to low strength variations in a longitudinal direction of the steel sheet, and a method for manufacturing the same.

Technical problems to be achieved in the present disclosure are not limited to the technical problems mentioned above, and other technical problems, not mentioned, will be clearly understood by those skilled in the art from the following description.

Technical Solution

According to an aspect of the present disclosure, a steel sheet having excellent hydrogen induced cracking resistance and longitudinal strength uniformity is provided.

The steel sheet includes, 0.02 wt % to 0.06 wt % of carbon (C), 0.1 wt % to 0.5 wt % of silicon (Si), 0.8 wt % to 1.8 wt % of manganese (Mn), 0.03 wt % or less of phosphorus (P), 0.003 wt % or less of sulfur (S), 0.06 wt % or less of aluminum (Al), 0.01 wt % or less of nitrogen (N), 0.01 wt % to 0.08 wt % of niobium (Nb), 0.005 wt % to 0.05 wt % of titanium (Ti), and 0.0005 wt % to 0.005 wt % of calcium (Ca), one or more selected from a group consisting of 0.05 wt % to 0.3 wt % of nickel (Ni), 0.05 wt % to 0.3 wt % of chromium (Cr), 0.02 wt % to 0.2 wt % of molybdenum (Mo), and 0.005 wt % to 0.1 wt % of vanadium (V), and a balance of iron (Fe) and other inevitable impurities, wherein a microstructure of the steel sheet is comprised of ferrite or a composite structure of ferrite and acicular ferrite, and upper bainite is included in an area of 5% or less in a center portion of the thickness of the steel sheet.

According to another aspect of the present disclosure, a method for manufacturing a steel sheet having excellent hydrogen induced cracking resistance and longitudinal strength uniformity is provided. The method for manufacturing the same includes operations of:

reheating a steel slab including 0.02 wt % to 0.06 wt % of carbon (C), 0.1 wt % to 0.5 wt % of silicon (Si), 0.8 wt % to 1.8 wt % of manganese (Mn), 0.03 wt % or less of phosphorus (P), 0.003 wt % or less of sulfur (S), 0.06 wt % or less of aluminum (Al), 0.01 wt % or less of nitrogen (N), 0.01 wt % to 0.08 wt % of niobium (Nb), 0.005 wt % to 0.05 wt % of titanium (Ti), and 0.0005 wt % to 0.005 wt % of calcium (Ca), one or more selected from a group consisting of 0.05 wt % to 0.3 wt % of nickel (Ni), 0.05 wt % to 0.3 wt % of chromium (Cr), 0.02 wt % to 0.2 wt % of molybdenum (Mo), and 0.005 wt % to 0.1 wt % of vanadium (V), and a balance of iron (Fe) and other inevitable impurities;

finish hot rolling the reheated steel slab in a temperature range of Ar3+50° C. to Ar3+150° C.; and cooling the steel slab at a cooling rate of 30° C. to 100° C./sec after the hot rolling operation, and performing inclined cooling to satisfy the following [cooling conditions] based on a temperature of the cooling point,

[Cooling Conditions]

Cooling start temperature: 650° C. to 850° C.

Cooling end temperature: 400° C. to 700° C.

Cooling start temperature—cooling end temperature: 100° C. to 350° C.

Advantageous Effects

According to the present disclosure, a steel sheet having excellent hydrogen induced cracking resistance, in particular, and at the same time, having high strength, and small variations in strength in a longitudinal direction may be effectively manufactured.

DESCRIPTION OF DRAWINGS

FIG. 1 shows a cooling start temperature and a cooling end temperature in Examples 1 to 3 and Comparative Examples 7 to 8 in an embodiment of the present disclosure.

FIG. 2A is a photograph of a microstructure of a steel sheet prepared in a conventional manner, and FIG. 2B is a photograph of a microstructure as an example of the present disclosure.

BEST MODE FOR INVENTION

The present disclosure is more suitable for thin material thick steel sheets having a plate length of 20 m or more and having a thickness of 10 mm or less. In the case of a thick steel sheet, winding is often not performed after a rolling process. In this case, a state of the sheet material is referred to as a plate. Usually, a thick steel sheet means a steel sheet having a thickness of 6 mm or more, and the present disclosure is targeted to a steel sheet having a thickness of 10 mm or less, but is not limited thereto.

The thick steel sheets having hydrogen induced cracking that have been supplied to a pipeline market has a minimum thickness of about 9.5 mm, and low-temperature rolling and air cooling are performed, or a conventional water cooling technique is applied thereto. Therefore, there is a problem that hydrogen induced cracking resistance is inferior, and the strength variation in the longitudinal direction of the plate is large.

In order to solve this problem, the inventors of the present invention have repeated research and experiment. In applying water cooling after hot rolling, while securing hydrogen induced cracking resistance, a precise control cooling technology applying a cooling method differently in a longitudinal direction, was devised, and a method of compensating for strength and suppressing an increase in a yield ratio through adjustment of alloy components has been devised in view of the fact that grain refinement and precipitate formation increase the strength of ferrite, in order to compensate for reduction in strength caused by ferrite formation in a longitudinal direction.

Hereinafter, a steel sheet of the present disclosure, having excellent hydrogen induced cracking resistance, and having excellent strength uniformity due to little variations in strength in a length direction, will be described in detail. First, a composition range of an alloying component of the steel sheet of the present disclosure will be described in detail. In this case, the content of the alloying component is in weight %, and hereinafter, is expressed as %.

Carbon (C): 0.02% to 0.06%

Carbon (C) is closely related to a manufacturing method together with other components. Among alloying components of steel, C affects properties of steel the greatest. If the C content is less than 0.02%, a cost of component control during a steelmaking process may occur excessively, and a welding heat-affected zone may be softened more than necessary. On the other hand, when the C content exceeds 0.06%, the hydrogen induced cracking resistance of the steel sheet is reduced and the weldability is reduced. Therefore, the C content is preferably 0.02% to 0.06%.

Silicon (Si): 0.1% to 0.5%

Silicon (Si) not only acts as a deoxidizer in a steelmaking process, but also serves to increase strength of a steel material. When the Si content exceeds 0.5%, low-temperature toughness and weldability of the material decrease, and scale peelability decreases during rolling. On the other hand, when the content of Si is less than 0.1%, manufacturing costs may increase, so the content of Si is preferably 0.1% to 0.5%.

Manganese (Mn): 0.8% to 1.8%

Manganese (Mn) is an element improving a quenching property of steel without inhibiting low-temperature toughness. It is preferable that Mn is included in an amount of 0.8% or more. However, when Mn exceeds 1.8%, center segregation occurs, and the low-temperature toughness is lowered, as well as the hardenability of the steel is increased and the weldability is deteriorated. In addition, since the center segregation of Mn is a factor that causes hydrogen induced cracking, it is preferable to set the content of Mn to 0.8% to 1.8%. In particular, in order to suppress the center segregation, it is more preferable to include Mn in an amount of 0.8% to 1.6%.

Phosphorous (P): 0.03% or Less

Phosphorous (P) is an impurity element, and when the content of P exceeds 0.03%, not only weldability is significantly lowered, but also low-temperature toughness is reduced. In particular, in order to secure the low-temperature toughness, it is more preferable to include P in an amount of 0.01% or less.

Sulfur (S): 0.003% or Less

Sulfur (S) is an impurity element, and when the content of S exceeds 0.003%, there is a problem of reducing ductility, low-temperature toughness, and weldability of steel. Therefore, the content of S is preferably 0.03% or less. In particular, S may be combined with Mn to form a Mns inclusion to lower hydrogen induced cracking resistance of steel, such that it is more preferable to include S in an amount of 0.002% or less.

Aluminum (Al): 0.06% or Less (Excluding 0%)

Al typically serves as a deoxidizer to remove oxygen by reacting with oxygen present in molten steel. Therefore, Al is generally added to have sufficient deoxidizing power in a steel material. However, when Al is added in excess of 0.06%, a large amount of oxide-based inclusions is formed, thereby inhibiting the low-temperature toughness and hydrogen induced cracking resistance of the material, so the content of Al is preferably 0.06% or less.

Nitrogen (N): 0.01% or Less

Since N is difficult to remove completely from steel industrially, an upper limit of N is 0.01%, which is an allowable range in a manufacturing process. N forms a nitride with Al, Ti, Nb, V, etc., hindering austenite grain growth and helps to improve toughness and strength. However, since the content of N is excessively included in excess of 0.01%, N in a solid state exists, and N in the solid state adversely affects low-temperature toughness, and therefore, it is preferable to include N in an amount of 0.01% or less.

Niobium (Nb): 0.005% to 0.08%

Niobium (Nb) is employed during slab reheating, and suppresses austenite grain growth during hot rolling, and then precipitates to serve to improve strength of steel. In addition, Nb combines with carbon to be precipitated, thereby increasing the strength of the steel while minimizing an increase in a yield ratio. However, when Nb is less than 0.005%, there is no effect of improving the strength by adding Nb. When Nb is excessively included in excess of 0.08%, austenite grains are not only refined more than necessary, low-temperature toughness and hydrogen induced cracking resistance by coarse precipitates are reduced, the Nb content is preferably 0.005 to 0.08%.

Titanium (Ti): 0.005% to 0.05%

Titanium (Ti) is an effective element that inhibits austenite grain growth in a form of TiN by combining with N when slab reheating. However, when Ti is included in amount of less than 0.005%, austenite grains become coarse and low-temperature toughness decreases. On the other hand, when Ti exceeds 0.05%, coarse Ti-based precipitates are formed, so low-temperature toughness and hydrogen induced cracking resistance decrease, so Ti is preferably included in an amount of 0.005 to 0.02%. It is more preferable to include Ti in an amount of 0.03% or less in terms of low-temperature toughness.

Calcium (Ca): 0.0005% to 0.005%

Ca serves to suppress Mns segregation causing hydrogen induced cracking by forming CaS by combining with S during a steelmaking process. When Ca is included in an amount less than 0.0005%, Ca cannot serve to suppress MnS. When Ca is included in excess of 0.0005%, Ca forms a CaO inclusion as well as forms CaS, such that Ca serves to cause hydrogen induced cracking by the inclusion. Therefore, the content of Ca is preferably 0.0005% to 0.005%, and more preferably 0.001% to 0.003% in terms of hydrogen induced cracking.

In addition to the alloy components, the steel sheet of the present disclosure may further include one or more of nickel (Ni), chromium (Cr), molybdenum (Mo), and vanadium (V). Each thereof will be described below.

Nickel (Ni): 0.05% to 0.3%

Ni is an element improving toughness of steel and is added to increase strength of steel without deteriorating the low-temperature toughness. However, if Ni is less than 0.05%, there is no effect of increasing the strength due to an addition of Ni, and when Ni exceeds 0.3%, a price increase due to the addition of Ni becomes a problem, so the content of Ni is preferably 0.05% to 0.3%.

Chrome (Cr): 0.05% to 0.3%

When the slab is reheated, Cr is preferably included in an amount of 0.05% or more in order to increase the quenching property of the steel. However, when the content of Cr exceeds 0.3%, weldability decreases, so it is preferable that Cr is included in an amount of 0.05% to 0.3%.

Molybdenum (Mo): 0.02% to 0.2%

Mo is an element having a similar or more active effect to Cr and serves to increase a quenching property of a steel material, and increase the strength of the steel material. However, when Mo is added in an amount of less than 0.02%, it is difficult to secure the quenching property of steel, When the Mo content exceeds 0.2%, an upper bainite structure is formed, thereby forming a structure vulnerable to low-temperature toughness and inhibiting hydrogen induced cracking resistance. Thus, the Mo content is preferably 0.02% to 0.2%.

Vanadium (V): 0.005% to 0.1%

V may serve to increase the strength by increasing a quenching property of a steel material. However, if the content of V is less than 0.005%, there is no effect of increasing the quenching property, and when V exceeds 0.1%, low-temperature phases are formed due to the increase in quenching property of the steel, thereby reducing the hydrogen induced cracking resistance. Thus, the content of V is preferably 0.005% to 0.1%.

In addition to the above components, the remainder includes Fe and unavoidable impurities. However, an addition of other alloy elements is not excluded without departing from the technical spirit of the present disclosure.

In the steel sheet of the present disclosure, it is preferable that a weight ratio (Ca/S) of the Ca and S is 0.5 to 5.0. The Ca/S ratio is an index representing MnS center segregation and coarse inclusion formation, and when the Ca/S ratio is less than 0.5, Mns is formed in the center portion of the thickness of the steel sheet to reduce hydrogen induced cracking resistance. On the other hand, when the Ca/S ratio exceeds 5.0, the Ca/S ratio is preferably 0.5 to 5.0 since a Ca-based coarse inclusion is formed to lower hydrogen induced cracking resistance.

In a steel sheet of the present disclosure, it is preferable that the total amounts of Cr and Mo (Cr+Mo) is 0.1% to 0.4% (% by weight). The Cr and Mo are elements increasing a carbon equivalent of steel except C and Mn, which are dominant in the strength and hydrogen induced cracking properties of a steel material. When the total amounts thereof exceeds 0.4%, an upper bainite structure is formed to increase the strength of the steel more than necessary and at the same time decrease the hydrogen induced cracking resistance. On the other hand, when the content thereof is less than 0.1%, since the strength of the steel is not easily secured, the content thereof is preferably 0.1% to 0.4%.

The steel sheet of the present disclosure is a plate having a length of 20 m or more, and is preferably a thick plate material having a thickness of 10 mm or less. In the steel sheet of the present disclosure, it is preferable that the variations in strength in the longitudinal direction of the plate is maintained at 50 MPa or less.

A microstructure of the steel sheet of the present disclosure is preferably a matrix structure of ferrite or a composite structure of ferrite and acicular ferrite. Meanwhile, in some low carbon steels, the acicular ferrite may be described as bainite. Therefore, in the present disclosure, it is understood that the acicular ferrite and bainite are the same. In the steel sheet of the present disclosure, it is preferable that the matrix structure is uniformly formed over an entire direction of the steel sheet. As an example, when manufactured in a conventional manner, as shown in FIG. 2A, there was a difference in a type and size of a microstructure of a front-end portion and a rear-end portion of the manufactured steel sheet. For example, ferrite and bainite are formed at the front-end portion, but coarse ferrite is formed at the rear-end portion, causing a difference in physical properties. However, the microstructure of the steel sheet obtained by the present disclosure, as shown in FIG. 2B, it is preferable that there is no possible difference in the type and size of the microstructure in the front-end portion and the rear-end portion.

In the present disclosure, a microstructure average grain size (a ferrite grain size (FGS)) is preferably 2 μm to 30 μm. It is preferable that the microstructure grain has a difference in an average grain size in the longitudinal direction of 5 μm or less. The difference in the average grain size in the longitudinal direction of 5 μm or less means that the difference in the sizes between the grains observed at the front-end portion and the rear-end portion of the plate of about 20 m or more is not large, that is, the grain variations in the steel sheet is 5 μm or less. The crystal grains are preferably measured at ¼*t of the thickness of the steel sheet.

Meanwhile, in the steel sheet of the present disclosure, to secure hydrogen induced cracking characteristics, it is preferable to suppress the formation of upper bainite that lowers the hydrogen induced cracking resistance, such that it is preferable that the upper bainite in the center portion of the thickness (within 3 mm above and below, based on the center of the thickness) is preferably 5% or less in an area fraction.

Hereinafter, an example of a method for manufacturing the steel sheet of the present disclosure will be described in detail. The method for manufacturing the steel sheet of the present disclosure is not limited to the method described below, and is provided by the inventors as an example.

The method of manufacturing the steel sheet of the present disclosure is prepared through processes of preparing a steel slab satisfying the alloy component and composition range, reheating the steel slab, and hot rolling, and then cooling the steel slab.

First, a steel slab satisfying the above-described alloy component and composition range is prepared. The prepared steel slab is reheated to a temperature range of 1100° C. to 1300° C. In a process of heating a steel slab at a high-temperature for hot rolling, when the heating temperature exceeds 1300° C. proposed in the present disclosure, not only does the scale defect increase, but the austenite grains become coarse to increase the quenching properties of steel, and increase the upper bainite fraction in the center portion, so that the hydrogen induced cracking resistance is reduced. In terms of hydrogen induced cracking resistance of the strength of the steel sheet, it is more preferably 1150° C. to 1250° C.

Hot rolling is performed on the reheated steel slab. Finish hot rolling of the hot rolling is preferably performed in a temperature range of Ar3+50° C. to Ar3+250° C. When the hot finish rolling temperature range is higher than Ar3+250° C., an upper bainite structure is formed due to an increase in quenching properties due to grain growth, thereby reducing hydrogen induced cracking resistance, and when the hot finish rolling temperature range is lower than Ar3+50° C., a cooling start temperature becomes too low, thereby reducing the strength of steel due to an excessive air-cooled ferrite fraction. Thus, the hot finish rolling temperature is preferably Ar3+50° C. to Ar3+250° C.

It is preferable that a cumulative reduction ratio of the hot finish rolling is 50% or more. When the cumulative reduction ratio is less than 50%, recrystallization by rolling does not occur to a center portion, and grains are coarsened at the center portion and low-temperature toughness is deteriorated, so the cumulative reduction ratio of the hot finish rolling is preferably 50% or more.

The steel sheet of the present is prepared by cooling after the hot rolling process. When the cooling is performed, an average cooling rate is preferably 30° C. to 100° C./sec. When the cooling rate is less than 30° C./sec, grains are coarsened, it is difficult to secure the strength of the steel material, and when the cooling rate exceeds 100° C./sec, upper bainite in a matrix structure may increase and deteriorate the hydrogen induced cracking resistance of steel, so the cooling rate is preferably 30° C. to 100° C./sec.

Meanwhile, in a cooling process, after the hot rolling, precise cooling is performed in the longitudinal direction of the plate, and it is preferable to perform inclined cooling satisfying the following [cooling conditions] based on the temperature at the point where cooling is actually performed.

[Cooling Conditions]

Cooling start temperature: 650° C. to 850° C.

Cooling end temperature: 400° C. to 700° C.

Cooling start temperature—cooling end temperature: 100° C. to 350° C.

In the [Cooling conditions], a temperature at a point of being cooled means that a temperature at a point at which a refrigerant (water) directly contacts the steel sheet when cooling (for example, during water cooling, may not be an average temperature of an entire temperature of the plate. When a cooling start temperature at a corresponding point is less than 650° C., excessive air-cooled ferrite is formed, and thus it is difficult to secure sufficient strength, and variations in strength for each location occur. In addition, when the temperature exceeds 850° C., the cooling start temperature is preferably 650° C. to 850° C. because the reheating temperature is increased to over 1300° C. to secure a cooling start temperature or an additional heating device is required during rolling.

When the cooling end temperature exceeds 700° C., phase transformation due to water cooling does not occur, such that it is difficult to secure the strength. When the cooling end temperature is lower than 400° C., formation of upper bainite by water cooling deteriorates hydrogen induced cracking resistance, so the cooling end temperature is preferably 400° C. to 700° C.

The steel sheet of the present disclosure is characterized by having high yield strength in the longitudinal direction of the plate of 20 m or more, and at the same time, securing a uniform microstructure, and reducing variations in strength. To this end, since the cooling start temperature decreases toward the rear-end portion in the longitudinal direction of the plate, it is preferable to perform inclined cooling in which the cooling end temperature is controlled according to the change in the cooling start temperature.

That is, when the difference between the cooling start temperature and the cooling end temperature is lower than 100° C., based on the front-end portion of the plate, it is characterized that it is difficult to secure strength because water cooling is insufficient, whereas when the difference therebetween exceeds 350° C., it is easy to secure the strength of the front-end portion, but large variations in strength with the rear-end portion may occur. Meanwhile, when the difference between the cooling start temperature and the cooling end temperature based on the rear-end portion is less than 100° C., the variations in strength from the front-end portion having high strength end cannot be reduced. When the difference therebetween exceeds 350° C., the cooling end temperature is lower than 400° C., and hydrogen induced cracking resistance due to the formation of upper bainite decreases, so the cooling start temperature–the cooling end temperature is preferably 100 to 350° C.

[Mode for Invention]

Hereinafter, embodiments of the present disclosure will be described in detail. It should be noted that the following examples are intended to illustrate preferred embodiments of the invention and are not intended to limit the scope of the disclosure. The scope of the present disclosure is determined by the matters described in the claims and reasonably inferred therefrom.

(Example)

A steel slab satisfying the composition range of the alloy of Table 1 (units are represented by weight %, and a balance of Fe and other inevitable impurities was prepared, and a steel sheet was manufactured using a manufacturing process of Table 2 below. In Table 1 below, steel types 1 to 3 satisfy the alloy composition of the present disclosure, whereas steel types 4 to 7, which differ in that they do not conform to the alloy composition of the present disclosure.

In Table 2, general cooling is a common cooling method, and the cooling end temperature of the entire plate is similar, but an inclined cooling method proposed in the present disclosure is to control the cooling end temperature in consideration of the cooling start temperature and changes for each blade length. That is, as shown in FIG. 1, in the Inventive Example of the present disclosure, inclined cooling, in which cooling in the front-end portion or the rear-end portion is different was performed, whereas in Comparative Examples 7 and 8, normal general cooling in which the cooling control in the front-end portion and the rear-end portion is not different was used to be performed. Based on Table 2 below, when inclined cooling is performed, a cooling rate tends to be higher in the rear-end portion is higher than that of the front-end portion, whereas in the case of general cooling, a cooling rate tends to be higher in the front-end portion than that of the rear-end portion. This is because when the same amount of cooling water is provided, a cooling width is wider on a higher temperature side. In addition, in the case of general cooling, there is no significant difference in the cooling end temperature in the front-end portion or the rear-end portion, but in the case of inclined cooling, it can be seen that the cooling end temperature of the front-end portion or the rear-end portion is 50° C. or higher.

TABLE 1

| Steel type | C | Si | Mn | P | S | Al | N | Nb | Ti | Ca | Ni | Cr | Mo | V | Cr + Mo | Ca/S |
|---|---|---|---|---|---|---|---|---|---|---|---|---|---|---|---|---|
| 1 | 0.041 | 0.25 | 1.25 | 0.007 | 0.0006 | 0.025 | 0.0035 | 0.046 | 0.012 | 0.0019 | 0 | 0.12 | 0.08 | 0.02 | 0.2 | 3.2 |
| 2 | 0.039 | 0.23 | 1.35 | 0.008 | 0.0007 | 0.023 | 0.0039 | 0.055 | 0.013 | 0.0016 | 0.08 | 0.19 | 0 | 0.03 | 0.19 | 2.3 |
| 3 | 0.043 | 0.22 | 1.28 | 0.006 | 0.0005 | 0.026 | 0.0042 | 0.048 | 0.011 | 0.0017 | 0 | 0 | 0.18 | 0 | 0.18 | 3.4 |
| 4 | 0.075 | 0.26 | 1.32 | 0.006 | 0.0005 | 0.023 | 0.0043 | 0.043 | 0.013 | 0.0016 | 0.1 | 0.13 | 0.08 | 0 | 0.21 | 3.2 |
| 5 | 0.038 | 0.24 | 1.94 | 0.004 | 0.0005 | 0.022 | 0.0042 | 0.042 | 0.014 | 0.0015 | 0 | 0.12 | 0.1 | 0.03 | 0.22 | 3.0 |
| 6 | 0.045 | 0.28 | 1.22 | 0.009 | 0.0008 | 0.026 | 0.0038 | 0 | 0.011 | 0.0016 | 0.08 | 0.08 | 0.13 | 0.02 | 0.21 | 2.0 |
| 7 | 0.043 | 0.27 | 1.23 | 0.008 | 0.0007 | 0.028 | 0.004 | 0.043 | 0.011 | 0.0019 | 0 | 0.27 | 0.18 | 0.04 | 0.45 | 2.7 |

TABLE 2

| | Steel type | Reheating temperature (° C.) | Ar3 (° C.) | Finish rolling temperature (° C.) | Finish rolling reduction ratio (° C.) | Cooling | Cooling point | Cooling start temperature (SCT, ° C.) | Cooling end temperature (FCT, ° C.) | SCT-FCT (° C.) | Cooling rate (° C./s) | Thickness of steel sheet (mm) |
|---|---|---|---|---|---|---|---|---|---|---|---|---|
| IE 1 | Steel type 1 | 1220 | 789 | 984 | 76 | Inclined cooling | Front-end portion | 815 | 600 | 215 | 43 | 7 |
| | | | | | | | Rear-end portion | 731 | 445 | 286 | 68 | |
| IE 2 | Steel type 2 | 1215 | 782 | 945 | 75 | | Front-end portion | 802 | 586 | 216 | 45 | 7 |
| | | | | | | | Rear-end portion | 729 | 489 | 240 | 86 | |
| IE 3 | Steel type 3 | 1212 | 780 | 976 | 75 | | Front-end portion | 799 | 599 | 200 | 49 | 7.5 |
| | | | | | | | Rear-end portion | 733 | 460 | 273 | 77 | |
| CE 1 | Steel type 4 | 1226 | 767 | 962 | 77 | | Front-end portion | 816 | 599 | 217 | 44 | 7 |
| | | | | | | | Rear-end portion | 725 | 456 | 269 | 72 | |
| CE 2 | Steel type 5 | 1232 | 733 | 980 | 76 | | Front-end portion | 795 | 598 | 197 | 44 | 7.2 |
| | | | | | | | Rear-end portion | 733 | 466 | 267 | 64 | |
| CE 3 | Steel type 6 | 1218 | 782 | 977 | 76 | | Front-end portion | 800 | 550 | 250 | 53 | 7.5 |
| | | | | | | | Rear-end portion | 722 | 485 | 237 | 67 | |
| CE 4 | Steel type 7 | 1230 | 780 | 974 | 76 | | Front-end portion | 808 | 579 | 229 | 45 | 9.3 |
| | | | | | | | Rear-end portion | 735 | 494 | 241 | 73 | |
| CE 5 | Steel type 1 | 1224 | 789 | 986 | 76 | | Front-end portion | 723 | 545 | 178 | 46 | 7 |
| | | | | | | | Rear-end portion | 625 | 443 | 183 | 48 | |

TABLE 2-continued

| | Steel type | Reheating temperature (° C.) | Ar3 (° C.) | Finish rolling temperature (° C.) | Finish rolling reduction ratio (° C.) | Cooling | Cooling point | Cooling start temperature (SCT, ° C.) | Cooling end temperature (FCT, ° C.) | SCT-FCT (° C.) | Cooling rate (° C./s) | Thickness of steel sheet (mm) |
|---|---|---|---|---|---|---|---|---|---|---|---|---|
| CE 6 | Steel type 1 | 1219 | 789 | 991 | 76 | | Front-end portion | 799 | 580 | 219 | 52 | 7 |
| | | | | | | | Rear-end portion | 723 | 343 | 380 | 91 | |
| CE 7 | Steel type 7 | 1225 | 789 | 984 | 76 | | Front-end portion | 801 | 612 | 189 | 76 | 7 |
| | | | | | | | Rear-end portion | 745 | 614 | 131 | 65 | |
| CE 8 | Steel type 1 | 1224 | 789 | 980 | 76 | | Front-end portion | 799 | 467 | 332 | 84 | 7 |

*IE: Inventive Example
CE: Comparative Example

In Table 2 above, Ar3 is calculated as 910−310*C−80*Mn−20*Cu−15*Cr−55*Ni−80*Mo+0.35* (thickness-8) (where thickness is the thickness of the steel sheet), and each element is a weight percent % value of the content. Meanwhile, SCT stands for a start cooling temperature, and FCT stands for a finish cooling temperature.

For the prepared steel sheet, as shown in Table 3, a microstructure was observed, and upper bainite in a center portion (within 3 mm up and down from the center of the thickness of the steel sheet) was observed to represent an area fraction. Ferrite grain size (FGS) variations in the longitudinal direction, yield strength, variations in the yield strength, tensile strength, variations in the tensile strength and hydrogen induced cracking sensitivity (a crack length ratio (CLR)) were measured and the results thereof were shown in Table 3 below.

The hydrogen induced cracking sensitivity (CLR) is represented by obtaining a percentage ratio of hydrogen induced cracking generated over an entire length of specimens after being tested in accordance with a method prescribed by the National Association of Corrosion Engineers (NAC).

TABLE 3

| | Location | Matrix structure | Upper bainite fraction in center portion (area %) | FGS (μm) | FGS change ratio in longitudinal direction (μm) | Yield strength (MPa) | Variation in yield strength (MPa) | Tensile strength (MPa) | Variation in tensil strength (MPa) | HIC (CLR, %) |
|---|---|---|---|---|---|---|---|---|---|---|
| IE 1 | Front-end portion | F | 0.6 | 18 | 3.0 | 472 | 16.0 | 546 | 10 | 0 |
| | Rear-end portion | F + AF | 1.2 | 15 | | 488 | | 556 | | 0 |
| IE 2 | Front-end portion | F | 0.9 | 18 | 1.0 | 478 | 2.0 | 543 | 2 | 0 |
| | Rear-end portion | F + AF | 1.5 | 17 | | 480 | | 545 | | 0 |
| IE 3 | Front-end portion | F | 1.2 | 19 | 3.0 | 479 | 6.0 | 553 | 3 | 0 |
| | Rear-end portion | F + AF | 2.2 | 16 | | 485 | | 556 | | 0 |
| CE 1 | Front-end portion | F | 1.6 | 16 | 2.0 | 512 | 17.0 | 599 | 22 | 6.1 |
| | Rear-end portion | F + AF | 6.8 | 18 | | 529 | | 621 | | 12.8 |
| CE 2 | Front-end portion | F | 1.9 | 17 | 3.0 | 528 | 7.0 | 603 | 19 | 4.3 |
| | Rear-end portion | F + AF | 7.2 | 14 | | 521 | | 622 | | 18.6 |

TABLE 3-continued

| | Location | Matrix structure | Upper bainite fraction in center portion (area %) | FGS (μm) | FGS change ratio in longitudinal direction (μm) | Yield strength (MPa) | Variation in yield strength (MPa) | Tensile strength (MPa) | Variation in tensil strength (MPa) | HIC (CLR, %) |
|---|---|---|---|---|---|---|---|---|---|---|
| CE 3 | Front-end portion | F | 1.1 | 26 | 2.0 | 436 | 4.0 | 495 | 28 | 0 |
| | Rear-end portion | F + AF | 3.5 | 24 | | 440 | | 523 | | 0 |
| CE 4 | Front-end portion | F | 2.1 | 19 | 2.0 | 535 | 9.0 | 608 | 10 | 12.5 |
| | Rear-end portion | F + AF | 7.5 | 17 | | 544 | | 618 | | 21.9 |
| CE 5 | Front-end portion | F | 0.8 | 18 | 7.0 | 487 | 43.0 | 553 | 49 | 0 |
| | Rear-end portion | F + AF | 1.3 | 25 | | 444 | | 505 | | 0 |
| CE 6 | Front-end portion | F | 0.7 | 16 | 1.0 | 476 | 13.0 | 541 | 29 | 0 |
| | Rear-end portion | | 8.1 | 15 | | 489 | | 570 | | 3.6 |
| CE 7 | Front-end portion | F | 0.5 | 21 | 2.0 | 469 | 31.0 | 533 | 35 | 0 |
| | Rear-end portion | F + P | 0.4 | 23 | | 438 | | 498 | | 0 |
| CE 8 | Front-end portion | F + AF | 1.1 | 16 | 2.0 | 548 | 60.0 | 599 | 51 | 1.2 |
| | Rear-end portion | F + AF | 1.6 | 18 | | 488 | | 548 | | 0 |

*IE: Inventive Example
CE: Comparative Example

In the notations of Table 3, F denotes ferrite, AF shows acicular ferrite, and P shows pearlite. FGS shows a ferrite grain size, and HIC shows hydrogen induced cracking sensitivity.

Meanwhile, as illustrated in Table 3 above, Inventive Examples 1 to 3 show cases in which an alloy component composition range and a process condition of the present disclosure are satisfied. In Inventive Example 1 to 3, it could be confirmed that the yield strength is 450 MPa or more, the variations in strength in the longitudinal direction of the plate is 50 MPa or less, and at the same time, it had excellent hydrogen induced cracking resistance at any point.

On the other hand, in the case of Comparative Examples 1 to 8 deviating from the alloy component composition range of the present disclosure, or deviating from the process conditions of the present disclosure, it can be confirmed that the microstructure proposed in the present disclosure could not be formed, sufficient strength could not be secured due to an influence such as an amount of change of FGS in a longitudinal direction of a plate, or the like, variations in strength in the longitudinal direction of the plate is greater than 50 MPa, or hydrogen induced cracking resistance is also insufficient.

Specifically, in the case of Comparative Examples 1, 2, and 4, it can be confirmed that a portion in which a fraction of the upper bainite in the center portion (within 3 mm above and below the center of the thickness of the steel sheet) exceeds 5% is formed, and the hydrogen induced cracking resistance is poor. In the case of Comparative Example 3, it can be confirmed that the alloy composition of the present disclosure is not satisfied and sufficient yield strength cannot be secured even by the manufacturing method of the present disclosure. In the case of Comparative Examples 5 and 6, it can be confirmed that the composition of the present disclosure is satisfied, but by deviating from the manufacturing method of the present disclosure, sufficient strength or hydrogen induced cracking resistance is not secured. In the case of Comparative Examples 7 and 8, it can also be confirmed the composition of the present disclosure is satisfied, but sufficient strength cannot be secured by performing general cooling, different from the present disclosure, or uniform strength in the longitudinal direction of the steel sheet cannot be secured.

The invention claimed is:

1. A steel sheet having excellent hydrogen induced cracking resistance and longitudinal strength uniformity, comprising:

0.02 wt % to 0.06 wt % of carbon (C), 0.1 wt % to 0.5 wt % of silicon (Si), 0.8 wt % to 1.8 wt % of manganese (Mn), 0.03 wt % or less of phosphorus (P), 0.003 wt % or less of sulfur (S), 0.06 wt % or less of aluminum (Al), 0.01 wt % or less of nitrogen (N), 0.01 wt % to 0.08 wt % of niobium (Nb), 0.005 wt % to 0.05 wt % of titanium (Ti), and 0.0005 wt % to 0.005 wt % of calcium (Ca), one or more selected from a group consisting of 0.05 wt % to 0.3 wt % of nickel (Ni), 0.05 wt % to 0.3 wt % of chromium (Cr), 0.02 wt % to 0.2 wt % of molybdenum (Mo), and 0.005 wt % to 0.1 wt % of vanadium (V), and a balance of iron (Fe) and other inevitable impurities, wherein Cr+Mo of the contents of Cr and Mo is 0.1% to 0.4%, a microstructure of the steel sheet is comprised of ferrite or a composite structure of ferrite and acicular ferrite, and upper bainite is included in an area of 5% or less in a center portion of the thickness of the steel sheet, the center portion of the thickness of the steel sheet is within 3 mm above and below, based on the center of the thickness, the steel sheet has CLR of 0% and variations in strength in the longitudinal direction of 50 MPa or less, the variations in strength is a difference in strength measured at a front-end portion and a rear-end portion of the steel sheet, and the strength is yield strength and tensile strength.

2. The steel sheet having excellent hydrogen induced cracking resistance and longitudinal strength uniformity of claim 1, wherein a difference in grain size in a longitudinal direction of the steel sheet is 5 μm or less, wherein the difference in grain size is the difference between grains sizes observed at a front-end portion and a rear-end portion of the steel sheet.

3. The steel sheet having excellent hydrogen induced cracking resistance and longitudinal strength uniformity of claim 1, wherein a ratio of Ca/S of the Ca and S is 0.5 to 5.0.

4. The steel sheet having excellent hydrogen induced cracking resistance and longitudinal strength uniformity of claim 1, wherein the steel sheet has an average grain size of 2 μm to 30 μm, which is measured at ¼*t of the Thickness of the Steel Sheet.

5. The steel sheet having excellent hydrogen induced cracking resistance and longitudinal strength uniformity of claim 1, wherein the steel sheet has a thickness of 10 mm or less, and a length of 20 m or more.

6. The steel sheet having excellent hydrogen induced cracking resistance and longitudinal strength uniformity of claim 1, wherein the steel sheet has 0.01% or less of phosphorus (P).

7. The steel sheet having excellent hydrogen induced cracking resistance and longitudinal strength uniformity of claim 1, wherein the steel sheet has 0.005-0.03 wt % or less of titanium (Ti).

8. The steel sheet having excellent hydrogen induced cracking resistance and longitudinal strength uniformity of claim 1, wherein the steel sheet has 0.001 wt % to 0.003 wt % of calcium (Ca).

9. The steel sheet having excellent hydrogen induced cracking resistance and longitudinal strength uniformity of claim 1, wherein the steel sheet has Cr+Mo of the contents of Cr and Mo is 0.18% to 0.4%.

10. The steel sheet having excellent hydrogen induced cracking resistance and longitudinal strength uniformity of claim 1, wherein the steel sheet has Cr+Mo of the contents of Cr and Mo is 0.19% to 0.4%.

11. The steel sheet having excellent hydrogen induced cracking resistance and longitudinal strength uniformity of claim 1, wherein the steel sheet has Cr+Mo of the contents of Cr and Mo is 0.18% to 0.22%.

* * * * *